US008173918B2

(12) United States Patent
Baier et al.

(10) Patent No.: US 8,173,918 B2
(45) Date of Patent: May 8, 2012

(54) PRESSURE SWITCH WITH AN INTEGRATED DIAPHRAGM AND SWITCH

(75) Inventors: Roland Baier, Esslingen (DE); Stefan Pfund, Winnenden (DE)

(73) Assignee: Norgren GmbH, Alpen (DE)

( * ) Notice: Subject to any disclaimer, the term of this patent is extended or adjusted under 35 U.S.C. 154(b) by 283 days.

(21) Appl. No.: 12/599,522

(22) PCT Filed: May 29, 2007

(86) PCT No.: PCT/EP2007/004719

§ 371 (c)(1),
(2), (4) Date: Nov. 10, 2009

(87) PCT Pub. No.: WO2008/145150

PCT Pub. Date: Dec. 4, 2008

(65) Prior Publication Data

US 2010/0300863 A1 Dec. 2, 2010

(51) Int. Cl.
*H01H 35/34* (2006.01)

(52) U.S. Cl. ..... 200/83 R; 200/83 A

(58) Field of Classification Search ..... 200/81 R, 200/83 R–83 W

See application file for complete search history.

(56) References Cited

U.S. PATENT DOCUMENTS

| | | | | |
|---|---|---|---|---|
| 3,286,059 | A | 11/1966 | Griffith | |
| 3,393,612 | A | 7/1968 | Gorgens et al. | |
| 3,444,341 | A * | 5/1969 | Mighton | 200/82 C |
| 3,585,328 | A * | 6/1971 | Fiore et al. | 337/320 |
| 3,816,685 | A * | 6/1974 | Fiore | 200/83 S |
| 3,864,537 | A * | 2/1975 | Fiore | 200/83 S |
| 3,953,692 | A * | 4/1976 | Amano et al. | 200/83 P |
| 4,743,716 | A * | 5/1988 | Tsukioka | 200/83 Y |
| 4,757,165 | A * | 7/1988 | Marcoux et al. | 200/83 P |
| 4,794,214 | A * | 12/1988 | Sanford | 200/83 P |
| 4,845,322 | A * | 7/1989 | Iwakiri et al. | 200/81 R |
| 5,055,826 | A * | 10/1991 | Ballyns | 340/442 |
| 5,060,520 | A * | 10/1991 | Strasser | 73/715 |
| 5,932,857 | A * | 8/1999 | Stander et al. | 200/83 B |
| 6,596,951 | B1 | 7/2003 | Cusak | |
| 7,162,925 | B2 | 1/2007 | Dietrich | |
| 2005/0028598 | A1 | 2/2005 | Vossenberg | |

FOREIGN PATENT DOCUMENTS

| | | | |
|---|---|---|---|
| DE | 2724824 | A1 | 12/1978 |
| DE | 3326680 | A1 | 1/1985 |
| EP | 0287531 | A2 | 10/1988 |
| EP | 552591 | A2 | 7/1993 |
| FR | 1250613 | | 1/1961 |
| FR | 2563373 | A3 | 10/1985 |
| GB | 1187394 | A | 4/1970 |
| GB | 2247953 | A | 3/1992 |

* cited by examiner

*Primary Examiner* — Michael Friedhofer

(74) *Attorney, Agent, or Firm* — The Ollila Law Group LLC

(57) ABSTRACT

A pressure switch (100) having a housing (101) and a connector (106) coupled to the housing (101) is provided. The housing (101) comprises a first chamber (212) and a second chamber (213). The first and second chambers (212, 213) are separated by an integrated diaphragm (102). The integrated diaphragm (102) has a first side (210) and a second side (211). The integrated diaphragm (102) flexes in response to a predetermined pressure acting on the second side (211). A first bushing (103) is inserted into the first chamber (212) of the housing (101) and coupled to the first side of the integrated diaphragm (102). The connector (106) comprises one or more electrical contact members (219) and at least one switch (105), the at least one switch (105) communicates with the first side (210) of the integrated diaphragm (102).

10 Claims, 2 Drawing Sheets

PRESSURE SWITCH WITH AN INTEGRATED DIAPHRAGM AND SWITCH

TECHNICAL FIELD

The present invention relates to pressure switches, and in particular, to a pressure switch with an integrated diaphragm.

BACKGROUND OF THE INVENTION

Pressure switches are incorporated in a wide variety of applications for controlling a device based on a pre-determined pressure. For example, if a pressure switch is in communication with a fluid (liquid or gas) supply, the pressure switch can activate once the pressure supply reaches a pre-determined pressure threshold. Similarly, the pressure switch may de-actuate at pressures substantially below the pre-determined pressure threshold. Conversely, the pressure switch could optionally de-actuate when the pressure supply reaches the pre-determined pressure threshold and actuate when the pressure supply returns to below the pre-determined pressure threshold. Thus, pressure switches can be used to determine whether the fluid pressure is above or below a pre-determined pressure threshold.

One type of pressure switch uses a diaphragm. Pressure can act on one side of the diaphragm and an actuating switch can be provided on the other side of the diaphragm. The diaphragm can have a known stiffness which only flexes when a pressure above a pre-determined value is applied. Therefore, in prior art pressure switches, a given diaphragm is only effective for fluid pressures within a relatively small range. If the fluid pressure acting on the diaphragm is normally above the threshold value for the diaphragm, the pressure switch may not be operable. Similarly, if the fluid pressure acting on the diaphragm never attains the pre-determined value, the diaphragm may not flex and actuate the switch.

A problem with prior art diaphragm pressure switches is providing a diaphragm that is operable across a broad range of pressures. Another problem in the past has been providing a pressure switch with a diaphragm that incorporates a minimum number of parts at a low cost. The present invention overcomes these difficulties by providing a pressure switch with an integrated diaphragm. Furthermore, a single integrated diaphragm may be used across a broad range of pressures. In addition, the pressure switch of the present invention comprises minimal parts, making it economical to produce.

SUMMARY OF THE INVENTION

A pressure switch is provided according to an embodiment of the invention. The pressure switch includes a housing and a connector coupled to the housing, the connector including one or more electrical contact members. The housing comprises a first chamber and a second chamber. The first and second chambers are separated by an integrated diaphragm. The integrated diaphragm has a first side facing the first chamber and a second side facing the second chamber. The integrated diaphragm flexes in response to a pre-determined pressure provided by a fluid in communication with the second side of the integrated diaphragm. A first bushing is inserted into the first chamber of the housing and coupled to the first side of the integrated diaphragm. The connector includes at least one switch. The at least one switch is in communication with the first side of the integrated diaphragm.

A method for forming a pressure switch is provided according to an embodiment of the invention. The pressure switch includes a housing and a connector coupled to the housing, the connector including one or more electrical contact members. The method is characterized by providing the housing with an integrated diaphragm and positioning the integrated diaphragm in the housing to divide the housing into a first chamber and a second chamber. The method is further characterized by providing the integrated diaphragm with a first side facing the first chamber and a second side facing the second chamber, wherein the integrated diaphragm flexes in response to a pre-determined pressure provided by a fluid pressure acting on the second side of the integrated diaphragm. The method is further characterized by inserting a first bushing into the first chamber of the housing and coupling the first bushing with the first side of the integrated diaphragm. The method is further characterized by providing the connector with at least one switch, the at least one switch is in communication with the first side of the integrated diaphragm.

Aspects

In one embodiment of the invention, the first bushing comprises an upper portion and a lower portion, the upper portion including a first inner diameter and the lower portion including a second inner diameter, the first inner diameter being larger than the second inner diameter.

In another embodiment of the invention, the second inner diameter is coupled to the first side of the integrated diaphragm.

In another embodiment of the invention, the second inner diameter substantially reduces the area of the integrated diaphragm that can flex in response to the pressure acting on the second side of the integrated diaphragm.

In another embodiment of the invention, the invention further comprises a second bushing located in the second chamber of the housing, the second bushing includes a top portion that provides a buffer between the fluid and the integrated diaphragm.

In another embodiment of the invention, the top portion of the second bushing includes one or more holes allowing the integrated diaphragm to communicate directly with the fluid.

In another embodiment of the invention, the invention further comprises a second bushing located in the second chamber, wherein the second bushing includes a threaded section which can configure the pressure switch for a desired connector size and type.

In one method of the invention, the first bushing comprises an upper portion and a lower portion, wherein the upper portion includes a first inner diameter and the lower portion includes a second inner diameter, the first inner diameter being larger than the second inner diameter.

In another method of the invention, the method further comprises coupling the second inner diameter of the first bushing with the first side of the integrated diaphragm.

In another method of the invention, the second inner diameter substantially reduces the area of the integrated diaphragm that can flex in response to the fluid pressure acting on the second side of the integrated diaphragm.

In another method of the invention, the method further comprises inserting a second bushing into the second chamber of the housing, wherein the second bushing includes a top portion that provides a buffer between the fluid and the integrated diaphragm.

In another method of the invention, the method further comprises providing one or more holes in the top portion of the second bushing allowing the integrated diaphragm to communicate directly with the fluid.

In another method of the invention, the method further comprises inserting a second bushing into the second chamber, wherein the second bushing includes a threaded section which can configure the pressure switch for a desired connector size and type.

DETAILED DESCRIPTION OF THE INVENTION

Figure 1:
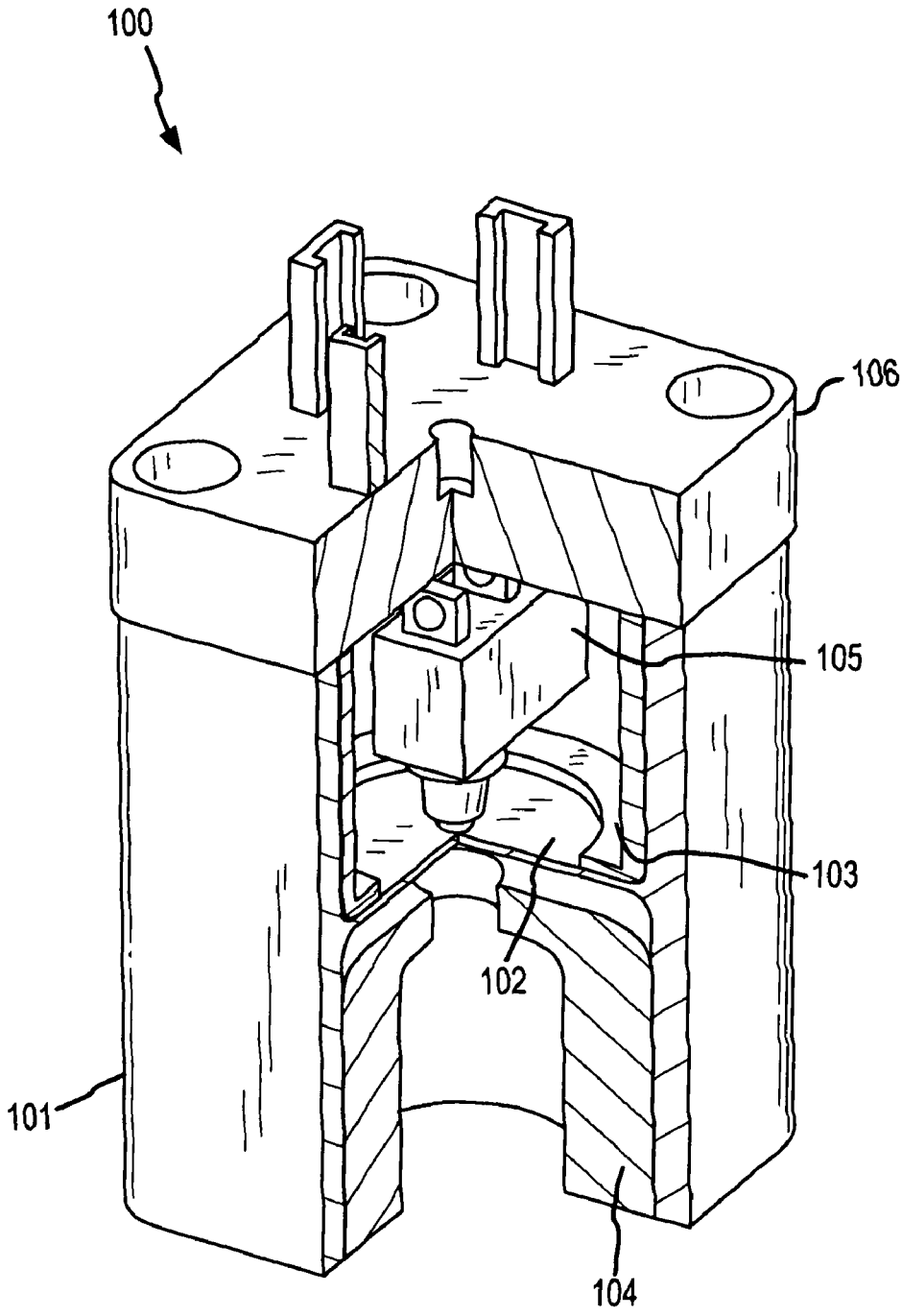
FIG. 1 shows a partial cross-sectional view of a pressure switch according to an embodiment of the invention.
Figure 2:
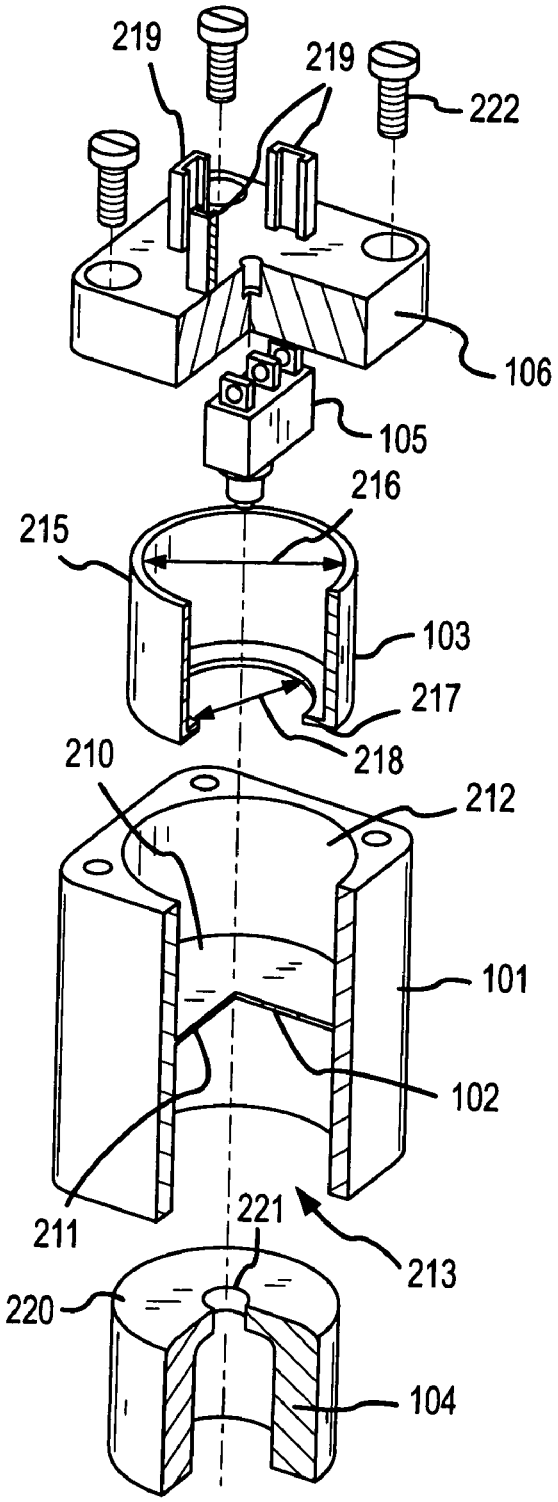
FIG. 2 shows an exploded partial cross-sectional view of the pressure switch according to an embodiment of the invention.

FIGS. 1 & 2 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

FIG. 1 shows a partial cross-sectional view of a pressure switch 100 according to an embodiment of the invention. The pressure switch 100 includes a housing 101, an integrated diaphragm 102, a first bushing 103, a second bushing 104, a switch 105, and a connector 106. According to an embodiment of the invention, the integrated diaphragm 102 is a substantially integrated portion of the housing 101. The integrated diaphragm 102 can be molded as part of the housing 101. In this embodiment, the housing 101 and the integrated diaphragm 102 comprise a single substantially continuous part of the pressure switch 100.

The pressure switch 100 can be in communication with a fluid (not shown) having a pressure. The fluid can be a gas, liquid, or a combination thereof. When the pressure switch 100 is in communication with a fluid, the pressure provides a force on the integrated diaphragm 102. If the pressure of the fluid reaches a pre-determined threshold pressure, the integrated diaphragm 102 flexes upward, as shown in FIG. 1. When the integrated diaphragm 102 flexes upward, it contacts and actuates the switch 105. Actuating the switch 105 can perform a variety of functions. The precise action that takes place in response to the actuation of the switch 105 is not important for the purposes of the present invention and therefore should not limit the scope of the present invention.

While only a single switch 105 is shown in FIGS. 1 and 2, it should be understood that more than one switch 105 could be provided. Similarly, the precise switch used is not important for the purposes of the present invention and could comprise a number of switches generally known in the art. According to one embodiment of the invention, the switch 105 could comprise a mircroswitch, which is known in the art. According to another embodiment of the invention, the switch 105 could be provided as an integral part of the connector 106, as further discussed below. However, the switch 105 may also be provided as a separate part.

FIG. 2 shows an exploded partial cross-sectional view of the pressure switch 100 according to an embodiment of the invention. According to one embodiment of the invention, the housing 101 includes an integrated diaphragm 102. The integrated diaphragm 102 divides the housing 101 into a first chamber 212 and a second chamber 213. The integrated diaphragm 102 has a first side 210 facing the first chamber 212 and a second side 211 facing the second chamber 213. According to an embodiment of the invention, only the second chamber 213 is in communication with the pressurized fluid.

According to an embodiment of the invention, fluid enters the second chamber 213 and provides a force on the second side 211 of the integrated diaphragm 102. If the fluid pressure reaches a pre-determined pressure threshold, the integrated diaphragm 102 flexes in response to the force of the pressure. As the integrated diaphragm 102 flexes (upward as shown in FIGS. 1 and 2), the first side 210 of the integrated diaphragm 102 contacts with and actuates the switch 105. If the fluid pressure then returns to a value less than the pre-determined pressure threshold, the integrated diaphragm 102 relaxes and no longer contacts the switch 105. The switch 105 consequently de-actuates. While the above description describes the integrated diaphragm 102 as contacting the switch 105, it should be understood that the integrated diaphragm 102 may not be in direct contact with the switch 105. The switch 105 and/or integrated diaphragm 102 may be provided with a spacer or buffer and thus, the integrated diaphragm 102 would contact the switch 105 through the spacer or buffer. Similarly, while the above description describes the integrated diaphragm 102 as contacting the switch 105 only when flexed, it should be understood that the integrated diaphragm 102 may remain in contact with the switch 105 at all times.

According to an embodiment of the invention, the connector 106 is coupled to the housing 101 in some manner. For example, according to the embodiment shown in the Figures, the connector 106 can use a plurality of screws 222 to couple to the housing 101. It should be understood however, that other means of coupling the connector 106 to the housing 101 may be used such as adhesives, bonding, welding, etc.

The connector 106 can include one or more contact members 219 which can couple the pressure switch 100 to a variety of devices, such as a CPU, other circuits, or an emergency shut off valve. However, the invention should not be limited to the devices listed, and the contact members 219 can couple the pressure switch 100 to any number of other devices. The connector 106 can complete an enclosure of the housing 101, and specifically, an enclosure for the first chamber 212 of the housing 101. While the connector 106 is shown as substantially enclosing the first chamber 212 in both FIGS. 1 and 2, it should be understood that the connector 106 does not have to substantially enclose any portion of the housing 101.

The connector 106 can also include at least one integrated switch, such as switch 105, for example. When the connector 106 includes at least one integrated switch, a separate switch does not need to be provided. As a result, the number of separate components needed to produce the pressure switch 100 is reduced.

The pressure switch 100 can also be provided with a first bushing 103. The first bushing 103 can be inserted into the first chamber 212. According to one embodiment of the invention, the first bushing 103 is removably inserted into the first chamber 212. According to another embodiment of the invention, the first bushing 103 may be permanently inserted into the first chamber 212. In this embodiment, the first bushing 103 may be held in place using an adhesive, bonding, welding, or other known means. However, the precise means of holding the first bushing 103 in place is not important for the present invention, and therefore, should not limit the scope of the present invention.

The first bushing 103 comprises an upper portion 215 and a lower portion 217. As shown in FIG. 2, the upper portion 215 has a first inner diameter 216. The lower portion 217 can have a second inner diameter 218. As shown in FIGS. 1 and 2, the second inner diameter 218 is smaller than the first inner diameter 216. However, it should be understood that the second inner diameter 218 could be greater than or substantially equal to the first inner diameter 216.

In the embodiment shown in FIGS. 1 and 2, the lower portion 217 of the first bushing 103 is coupled to the first side 210 of the integrated diaphragm 102. The lower portion 217 may be either removably or substantially permanently coupled to the first side 210 of the integrated diaphragm 102. If the lower portion 217 is substantially permanently coupled to the first side 210 of the integrated diaphragm 102, it can be coupled using adhesive, bonding, welding, etc. Because the lower portion 217 of the first bushing 103 has a smaller inner diameter than the diameter of the integrated diaphragm 102, the first bushing 103 decreases the area of the integrated diaphragm 102 that can flex in response to the pressure provided on the second side 211 of the integrated diaphragm 102. As shown in the Figures, the area of the integrated diaphragm 102 that can flex is reduced by a distance substantially equal to the difference between the diameter of the first chamber 212 and the second inner diameter 218 of the first bushing 103. Because the area of the integrated diaphragm 102 that can flex is reduced, the force required to flex the integrated diaphragm 102 increases. This increased force raises the predetermined pressure required to flex the integrated diaphragm 102 and thus actuate the switch 105.

Accordingly, the pressure switch 100 may use first bushings 103 including different first and second inner diameters 216 & 218 depending on the particular application. For example, if the particular application that the pressure switch 100 is used for needs to have a higher pre-determined pressure before flexing the integrated diaphragm 102, the first bushing 103 can be inserted into the first chamber 212 of the housing 101. Because the second inner diameter 218 of the first bushing 103 is smaller than the diameter of the integrated diaphragm 102, the force required to flex the integrated diaphragm 102 increases. In this manner, the second inner diameter 218 of the first bushing 103 can be selected to substantially match the needs of the application. This allows a single diaphragm 102 to be used across a much broader range of pressures than would be capable if the first bushing 103 were not provided. This is because the first bushing 103 can be changed to adjust to the demands of the environment, instead of the housing 101 and diaphragm 102. Therefore, manufacturing costs may be reduced by producing only one or a small number of molds for the housing/diaphragm portion. Alternatively, a first bushing 103 including a much smaller second inner diameter 218 can be used in order to further increase the pressure capability of the pressure switch 100.

The pressure switch 100 may also include a second bushing 104. According to an embodiment of the invention, the second bushing 104 is inserted into the second chamber 213 of the housing 101. According to one embodiment, the second bushing 104 is removably inserted into the second chamber 213 of the housing 101. According to another embodiment, the second bushing 212 is substantially permanently inserted into the second chamber 213 of the housing 101. In this embodiment, the second bushing 104 may be held in place using an adhesive, bonding, welding, or other known means. However, the precise means of holding the second bushing 104 in place is not important for the present invention, and therefore, should not limit the scope of the present invention.

As shown in FIG. 2, the second bushing 104 can, in some embodiments, include a top portion 220. The top portion 220 can provide a buffer between the fluid and the integrated diaphragm 102. The top portion 220 can flex in response to the pressure provided by the fluid in a similar manner as the integrated diaphragm 102. According to an embodiment of the invention, a higher pressure is required to flex the top portion 220 of the second bushing 104, than is required to flex the integrated diaphragm 102. In this embodiment, the second bushing 104 can substantially protect the integrated diaphragm 102 from damage due to excessive pressures. When the top portion 220 of the second bushing 104 flexes, it can provide a force on the integrated diaphragm 102. This force flexes the integrated diaphragm 102 to actuate or de-actuate the switch 105.

According to an embodiment of the invention, the top portion 220 substantially contacts the integrated diaphragm 102 when the top portion 220 flexes. This contact causes the integrated diaphragm 102 to flex when the top portion 220 flexes.

According to another embodiment of the invention, the second bushing 104 has a threaded section (not shown). The thread section enables the pressure switch 100 to be coupled to a variety of devices. The second bushing 104 can be provided in a number of different sizes/types. In this manner, the pressure switch 100 can be coupled to different devices by replacing the second bushing 104 with a second bushing 104 of the appropriate connection type. Selection of an appropriate second bushing 104 can therefore configure the pressure switch 100 for a desired connector size and type. The second bushing 104 can also be provided with plug-in couplings (not shown), for example. The plug-in couplings can configure the pressure switch 100 for a desired connector size and type.

The second bushing 104 is shown in FIGS. 1 and 2 as having a substantially closed top portion 220 with a hole substantially in the middle, for fluid to come into the chamber 211. However, it should be understood that in some embodiments, the second bushing 104 can be provided with more than one hole in the top portion 220. The hole 221 allows the integrated diaphragm 102 to communicate directly with the fluid. Alternatively, the second bushing 104 can be provided having no top portion 220. This also allows the fluid to communicate directly with the second side 211 of the integrated diaphragm 102. This force, generated from the fluid pressure or as a result of the fluid pressure, flexes the integrated diaphragm 102 to actuate or de-actuate the switch 105. In embodiments in which the second bushing 104 either has a hole in the top portion 220 or no top portion 220 at all, the second bushing 104 is provided to couple the pressure switch 100 to a variety of devices.

According to another embodiment of the invention, the top portion 220 of the second bushing 104 can be provided with no hole. In this embodiment, when the second bushing 104 is inserted into the lower chamber 213, a gap exists between the top portion 220 and the integrated diaphragm 102. This gap can be pressurized during manufacturing, for example. When a gap is provided, the integrated diaphragm 102 can still flex in response to the top portion 220. In this embodiment, fluid pressure is applied to the underside of top portion 220 of the second bushing 104. When the pressure of the fluid exceeds a pre-determined threshold, the top portion 220 flexes. As the top portion 220 flexes, the pressurized gap forces the integrated diaphragm 102 to flex. In this manner, the integrated diaphragm 102 flexes substantially in response to the top portion 220.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other pressure switches, and not just to the embodiments described above and shown in the accompanying figures. Accordingly, the scope of the invention should be determined from the following claims.

We claim:

1. A pressure switch (100) including a housing (101) and a connector (106) coupled to the housing (101) and including one or more electrical contact members (219), the pressure switch (100) being characterized by:

the housing (101) comprising a first chamber (212) and a second chamber (213), the first and second chambers (212, 213) separated by an integrated diaphragm (102);

the integrated diaphragm (102) having a first side (210) facing the first chamber (212) and a second side (211) facing the second chamber (213), wherein the integrated diaphragm (102) flexes in response to a pre-determined pressure provided by a fluid in communication with the second side (211) of the integrated diaphragm (102);

a first bushing (103) inserted into the first chamber (212) of the housing (101), the first bushing (103) comprising an upper portion (215) with a first inner diameter (216) and a lower portion (217) with a second inner diameter (218) smaller than the first inner diameter (218), wherein the lower portion (217) is coupled to the first side (210) of the integrated diaphragm (102) to reduce an area of the integrated diaphragm (102) that can flex in response to the pressure acting on the second side (211) of the integrated diaphragm (102); and wherein the connector (106) includes at least one switch (105), the at least one switch (105) being configured to be actuated by the first side (210) of the integrated diaphragm (102).

2. The pressure switch (100) of claim 1, further comprising a second bushing (104) located in the second chamber (213) of the housing (101), wherein the second bushing (104) includes a top portion (220) that provides a buffer between the fluid and the integrated diaphragm (102).

3. The pressure switch (100) of claim 2, wherein the top portion (220) of the second bushing (104) includes one or more holes allowing the integrated diaphragm (102) to communicate directly with the fluid.

4. The pressure switch (100) of claim 1, further comprising a second bushing (104) located in the second chamber (213), wherein the second bushing (104) includes a threaded section which can configure the pressure switch (100) for a desired connector size and type.

5. The pressure switch (100) of claim 1, further comprising a second bushing (104) located in the second chamber (213), wherein the second bushing (104) includes a plug-in coupling (221) which can configure the pressure switch (100) for a desired connector size and type.

6. A method for forming a pressure switch (100) including a housing (101) and a connector (106) coupled to the housing (101), the connector (106) including one or more electrical contact members (219), the method characterized by:

providing the housing (101) with an integrated diaphragm (102), and positioning the integrated diaphragm (102) to divide the housing (101) into a first chamber (212) and a second chamber (213);

providing the integrated diaphragm (102) with a first side (210) facing the first chamber (212) and a second side (211) facing the second chamber (213), wherein the integrated diaphragm (102) flexes in response to a predetermined pressure provided by a fluid pressure acting on the second side (211) of the integrated diaphragm (102);

inserting a first bushing (103) into the first chamber (212) of the housing (101), the first bushing (103) comprising an upper portion (215) including a first inner diameter (216) and a lower portion (217) including a second diameter (218) smaller than the first diameter (216), and coupling the lower portion (217) [first bushing (103)] with the first side (210) of the integrated diaphragm (102) to substantially reduce an area of the integrated diaphragm (102) that can flex in response to the pressure acting on the second side (211) of the integrated diaphragm (102); and wherein the connector (106) includes at least one switch (105), the at least one switch (105) being configured to be actuated by the first side (210) of the integrated diaphragm (102).

7. The method of claim 6, further comprising inserting a second bushing (104) into the second chamber (213) of the housing (101), wherein the second bushing (104) includes a top portion (220) that provides a buffer between the fluid and the integrated diaphragm (102).

8. The method of claim 7, further comprising providing one or more holes in the top portion (220) of the second bushing (104) allowing the integrated diaphragm (102) to communicate directly with the fluid.

9. The method of claim 6, further comprising inserting a second bushing (104) into the second chamber (213), wherein the second bushing (104) includes a threaded section which can configure the pressure switch (100) for a desired connector size and type.

10. The method of claim 6, further comprising inserting a second bushing (104) into the second chamber (213), wherein the second bushing (104) includes a plug-in coupling, which can configure the pressure switch (100) for a desired connector size and type.

* * * * *